US005532555A

United States Patent [19]

Yamada

[11] Patent Number: 5,532,555

[45] Date of Patent: Jul. 2, 1996

[54] ELECTRONIC FLASH APPARATUS USING GATE CONTROLLED SWITCHING DEVICE DIRECTLY DRIVEN BY CPU

[75] Inventor: Hiroshi Yamada, Hachioji, Japan

[73] Assignee: Olympus Optical Co., Ltd., Tokyo, Japan

[21] Appl. No.: 391,730

[22] Filed: Feb. 21, 1995

[30] Foreign Application Priority Data

Mar. 7, 1994 [JP] Japan ..... 6-035563

[51] Int. Cl.[6] ..... H05B 37/00

[52] U.S. Cl. ..... 315/241 P; 315/241 S; 315/241 R

[58] Field of Search ..... 315/241 P, 241 S, 315/241 R; 354/145.1, 416

[56] References Cited

U.S. PATENT DOCUMENTS

| | | | |
|---|---|---|---|
| 4,839,686 | 6/1989 | Hosomizu et al. . | |
| 4,951,081 | 8/1990 | Hosomizu et al. . | |
| 5,053,802 | 10/1991 | Hirata . | |
| 5,075,714 | 12/1991 | Haguide et al. . | |
| 5,107,292 | 4/1992 | Tanaka et al. . | |
| 5,111,233 | 5/1992 | Yokonuma et al. . | |
| 5,130,738 | 7/1992 | Hirata . | |
| 5,140,201 | 8/1992 | Uenishi . | |
| 5,184,171 | 2/1993 | Uenishi | 315/241 P |
| 5,249,007 | 9/1993 | Tanaka . | |
| 5,250,977 | 10/1993 | Tanaka . | |
| 5,313,247 | 5/1994 | Hosomizu et al. . | |

FOREIGN PATENT DOCUMENTS

| | | |
|---|---|---|
| 1-124838 | 5/1989 | Japan . |
| 2-282529 | 11/1989 | Japan . |
| 2-131227 | 5/1990 | Japan . |
| 2-158097 | 6/1990 | Japan . |
| 2-287449 | 11/1990 | Japan . |
| 2-267532 | 11/1990 | Japan . |
| 2-282734 | 11/1990 | Japan . |
| 3-182095 | 8/1991 | Japan . |
| 3-216631 | 9/1991 | Japan . |
| 3-28031 | 9/1991 | Japan . |
| 3-212634 | 9/1991 | Japan . |
| 3-214595 | 9/1991 | Japan . |
| 3-230136 | 10/1991 | Japan . |
| 3-223730 | 10/1991 | Japan . |
| 4-42137 | 2/1992 | Japan . |
| 4-39640 | 2/1992 | Japan . |
| 4-114136 | 4/1992 | Japan . |
| 4-13897 | 5/1992 | Japan . |
| 4-192298 | 7/1992 | Japan . |
| 4-190335 | 7/1992 | Japan . |
| 4-96721 | 8/1992 | Japan . |
| 4-247439 | 9/1992 | Japan . |
| 4-256936 | 9/1992 | Japan . |
| 4-286896 | 10/1992 | Japan . |
| 4-319926 | 11/1992 | Japan . |
| 4-319927 | 11/1992 | Japan . |
| 4-344622 | 12/1992 | Japan . |
| 5-3095 | 1/1993 | Japan . |
| 5-19337 | 1/1993 | Japan . |

(List continued on next page.)

*Primary Examiner*—Frank Gonzalez
*Assistant Examiner*—Reginald A. Ratliff
*Attorney, Agent, or Firm*—Frishauf, Holtz, Goodman, Langer & Chick

[57] ABSTRACT

An electronic flash apparatus having a main capacitor for storing charges, a discharge light emitting tube for emitting light in accordance with the charges stored in the main capacitor, a CPU for performing camera sequence control, and an IGBT coupled to each of the discharge light emitting tube and the CPU. The CPU includes a light emission control terminal for controlling a light emission timing of the discharge light emitting tube and the CPU is supplied with a CPU operation voltage. The IGBT includes a gate terminal connected to the light emission control terminal of the CPU, a collector terminal, and an emitter terminal, wherein, responsive to the light emission control terminal inputting to the gate terminal a control voltage substantially equivalent to the CPU operation voltage, a channel is formed between the collector terminal and the emitter terminal and the charges of the main capacitor are discharged through the discharge light emitting tube.

15 Claims, 7 Drawing Sheets

FOREIGN PATENT DOCUMENTS

| | | |
|---|---|---|
| 5-34772 | 2/1993 | Japan . |
| 5-62786 | 3/1993 | Japan . |
| 5-101896 | 4/1993 | Japan . |
| 5-107606 | 4/1993 | Japan . |
| 5-114493 | 5/1993 | Japan . |
| 5-174988 | 7/1993 | Japan . |
| 5-275187 | 10/1993 | Japan . |
| 5-343191 | 12/1993 | Japan . |
| 6-119987 | 4/1994 | Japan . |

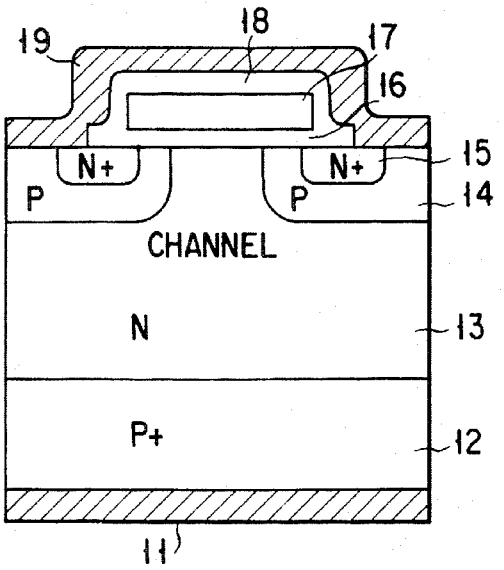
FIG. 2
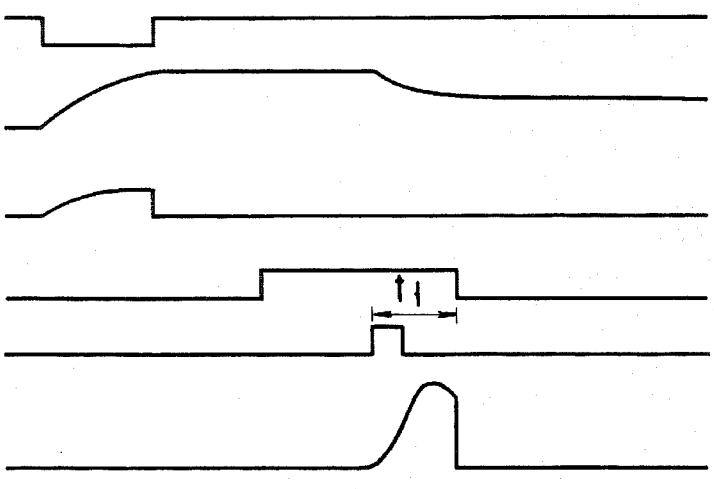
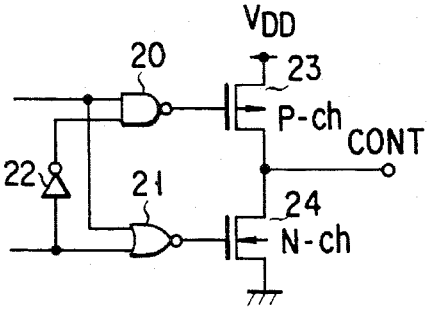
FIG. 4

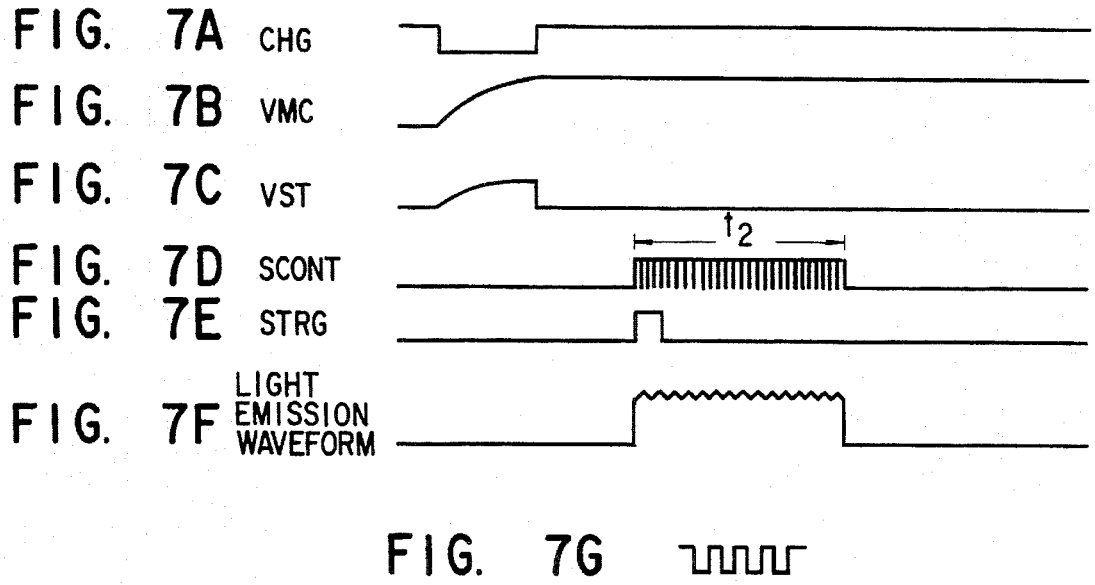
FIG. 7A CHG
FIG. 7B VMC
FIG. 7C VST
FIG. 7D SCONT
t2
FIG. 7E STRG
FIG. 7F LIGHT EMISSION WAVEFORM
FIG. 7G
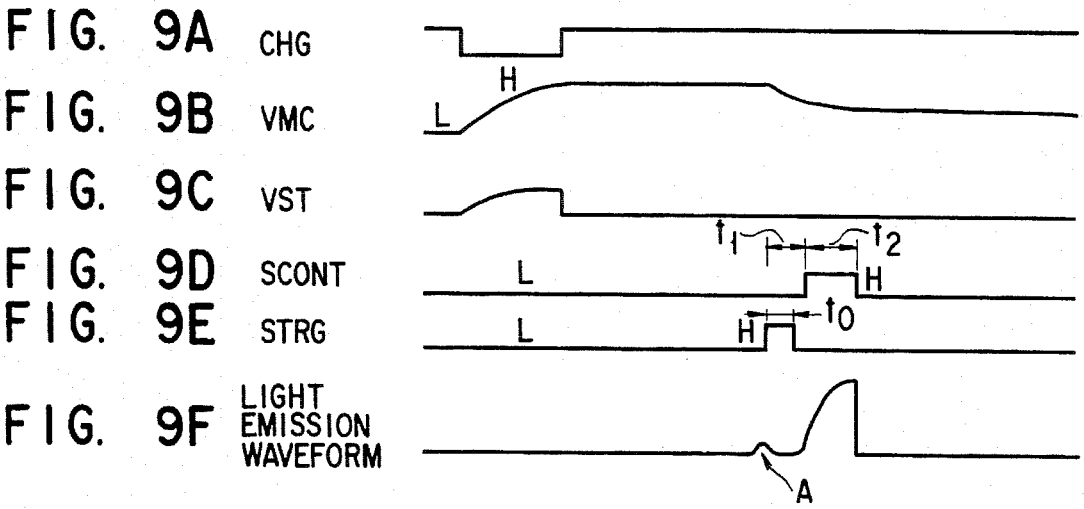
FIG. 9A CHG
FIG. 9B VMC
H
L
FIG. 9C VST
FIG. 9D SCONT
t1
t2
L
H
FIG. 9E STRG
L
H
t0
FIG. 9F LIGHT EMISSION WAVEFORM
A FIG. 10A STRG
FIG. 10B TRIGGER WAVEFORM
FIG. 10C SCONT
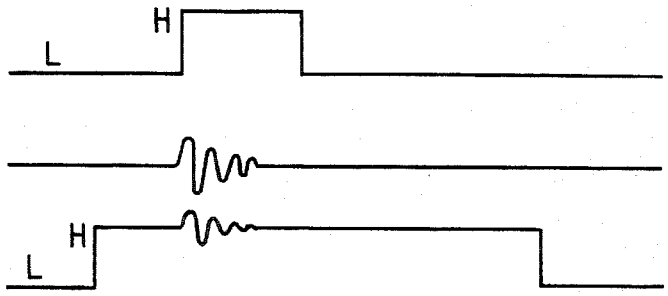
FIG. 11A STRG
FIG. 11B TRIGGER WAVEFORM
FIG. 11C SCONT
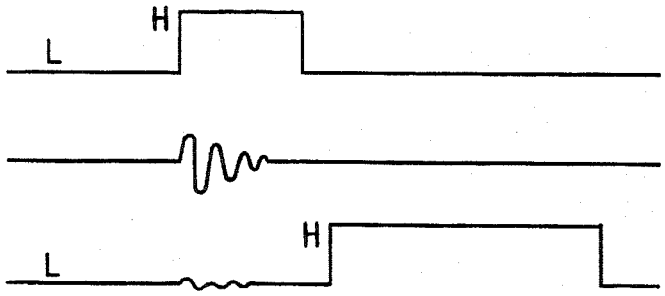
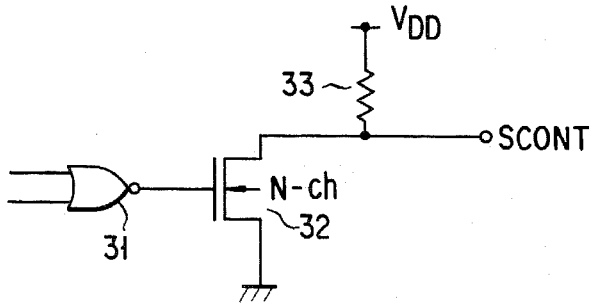
FIG. 12

ELECTRONIC FLASH APPARATUS USING GATE CONTROLLED SWITCHING DEVICE DIRECTLY DRIVEN BY CPU

BACKGROUND OF THE INVENTION

1. Field of the Invention

The present invention relates to an electronic flash apparatus and, more particularly, to an electronic flash apparatus using a gate controlled switching device.

The present invention also relates to an electronic flash apparatus having a gate controlled switching device and, more particularly, to an electronic flash light emission control circuit for preventing a gate controlled switching device from breakdown.

2. Description of the Related Art

In recent years, as an electronic flash apparatus for a camera, an electronic flash apparatus using a gate controlled switching device, e.g., an IGBT (Insulated Gate Bipolar Transistor), is used. For example, U.S. Pat. Nos. 4,839,686 and 4,951,081 disclose electronic flash apparatuses each using an IGBT having an arrangement in which the IGBT is turned on by a light emission instruction issued by a trigger signal, and is turned off by a light emission stop instruction.

However, the electronic flash apparatuses in U.S. Pat. Nos. 4,839,686 and 4,951,081 are inconvenient because the operation timings of a flash light emitting unit and the IGBT must accurately coincide with each other. In addition, the circuit arrangements of the electronic flash apparatuses become complex due to timing synchronization. Since gate control power supply circuits are required, the cost of the electronic flash apparatuses increase, and the electronic flash apparatuses have spatial limitations.

In order to solve the problem of the above complex circuit arrangement, for example, Jpn. UM Appln. KOKAI Publication No. 4-96721 discloses an electronic flash light apparatus in which a voltage is supplied from a main capacitor to a switching device control terminal in advance only when a power supply switch is in an ON state.

In the electronic flash light apparatus, however, a plurality of transistors and Zener diodes are required to ON/OFF-control the IGBT, and two lines are required to control light emission.

For this reason, strong demand has arisen for an electronic flash apparatus capable of suppressing an increase in cost and controlling a gate controlled switching device to control light emission without complicating a circuit arrangement.

In this case, the following must be additionally considered. That is, there is also realized an electronic flash apparatus in which a gate controlled switching device is controlled by a simple circuit arrangement which prevents delay of the start of light emission and breakdown of the gate controlled switching device, suppresses a manufacturing cost, and does not have spatial limitations, thereby controlling the light emission.

SUMMARY OF THE INVENTION

It is, therefore, an object of the present invention to provide a new and improved electronic flash apparatus in which an increase in cost is suppressed, a circuit arrangement is not made complex, and a gate controlled switching device is controlled to control light emission.

Also, it is, therefore, another object of the present invention to provide a new and improved electronic flash apparatus in which a gate controlled switching device is controlled by a simple circuit arrangement which prevents delay of the start of light emission and breakdown of the gate controlled switching device, suppresses a manufacturing cost, and is free from spatial limitations, thereby controlling the light emission.

According to an aspect of the present invention, there is provided an electronic flash apparatus comprising:

a main capacitor for storing charges;

a discharge light emitting tube for emitting light by the charges stored in the main capacitor;

a CPU (Central Processing Unit) for performing camera sequence control including control of a light emission timing of the discharge light emitting tube; and an IGBT (Insulated Gate Bipolar Transistor), having gate, collector, and emitter terminals, in which the gate terminal is connected to a light emission control terminal of the CPU, a channel is formed between the collector terminal and the emitter terminal by inputting a control voltage almost equal to an operation voltage of the CPU to the gate terminal, and the charges of the main capacitor are discharged through the discharge light emitting tube.

According to another aspect of the present invention, there is provided an electronic flash apparatus comprising:

a main capacitor for storing charges;

a discharge light emitting tube for emitting light by the charges stored in the main capacitor;

a CPU for performing camera sequence control including control of a light emission timing of the discharge light emitting tube;

trigger means for receiving a trigger signal from the CPU to excite the discharge light emitting tube; and an IGBT, having gate, collector, and emitter terminals, in which the gate terminal is connected to a light emission control terminal of the CPU, a channel is formed between the collector electrode and the emitter electrode by inputting a control voltage almost equal to an operation voltage of the CPU to the gate terminal, and the main capacitor is discharged through the discharge light emitting tube, the IGBT receiving the control voltage from the CPU after the trigger means operates.

In the electronic flash apparatus according to one aspect of the present invention, charges for causing the discharge light emitting tube of the electronic flash apparatus to emit light are stored in the main capacitor. In the discharge loop of the main capacitor, the discharge light emitting tube and the gate controlled switching device are connected in series with each other. The output terminal of the control circuit is directly connected to the gate control electrode of the gate controlled switching device. Therefore, the control circuit directly drives the gate controlled switching device such that the gate controlled switching device is turned on before the discharge light emitting tube emits light, and the gate controlled switching device is turned off by a light emission stop instruction.

In addition, in the electronic flash apparatus according to another aspect of the present invention, the gate controlled switching device is turned on a predetermined time after a light emission start signal is input to the trigger circuit, thereby controlling the timing of light emission.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 2 is a sectional view showing the structure of a general IGBT;

FIGS. 3A to 3F are timing charts for explaining the operation of the electronic flash apparatus in FIG. 1;

FIG. 4 is a circuit diagram of an output unit for a CONT terminal in a CPU in FIG. 1;

FIGS. 7A to 7G are timing charts for explaining the operation of the electronic flash apparatus according to the second embodiment;

FIGS. 9A to 9F are timing charts for explaining the operation of an electronic flash apparatus according to the third embodiment;

FIGS. 10A to 10C are timing charts of STRG and SCONT signals for performing light emission by the electronic flash apparatus of the first embodiment;

FIGS. 11A to 11C are timing charts of STRG and SCONT signals for performing light emission by an electronic flash apparatus according to the present invention;

FIG. 12 is a view showing an arrangement of a pull-up open-drain port serving as an output port for a CPU or the like.

DETAILED DESCRIPTION OF THE PREFERRED EMBODIMENTS

Figure 1:
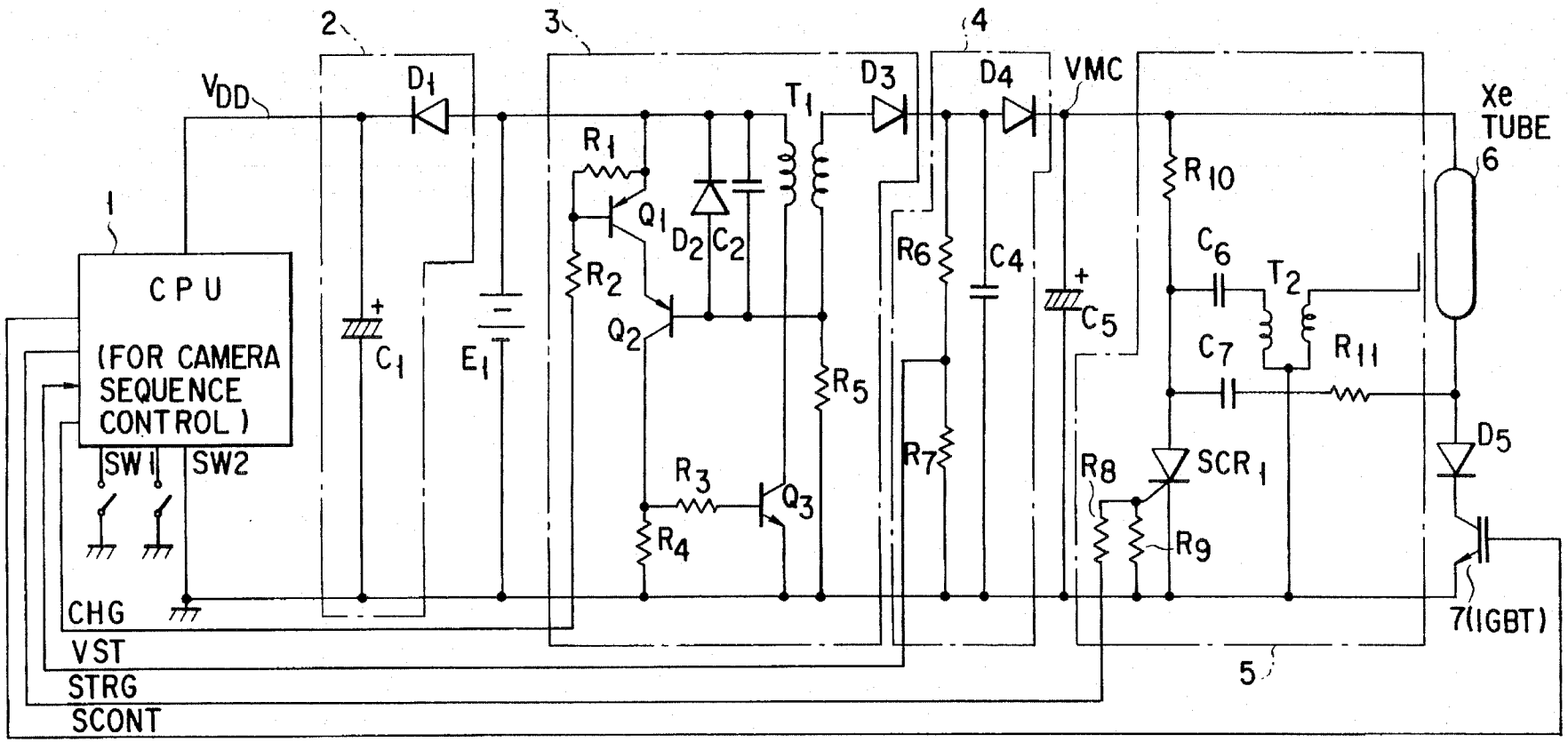
FIG. 1 is an electrical circuit diagram of an electronic flash apparatus according to the first embodiment of the present invention.

Reference will now be made in detail to the presently preferred embodiments of the invention as illustrated in the accompanying drawings, in which like reference characters designate like or corresponding parts throughout the drawings.

Embodiments of the present invention will be described below with reference to the accompanying drawings.

FIG. 1 is an electrical circuit diagram of an electronic flash apparatus according to the first embodiment of the present invention.

Referring to FIG. 1, reference numeral 1 denotes a central processing unit (CPU). In addition to a power supply battery $E_1$ and a main capacitor $C_5$, a power supply filter circuit 2, a step-up power supply circuit 3 for an electronic flash, a voltage detecting circuit 4 for detecting a charge voltage of the main capacitor $C_5$, a trigger circuit 5, a flash light discharge tube (Xe tube) 6, and a series circuit of a diode $D_5$ and an IGBT 7 serving as a gate controlled switching device are connected parallel to the CPU 1.

The power supply filter circuit 2 is constituted by a capacitor $C_1$ connected parallel to the power supply battery $E_1$ and a diode $D_1$ connected between the positive terminal of the capacitor $C_1$ and the positive terminal of the power supply battery $E_1$.

The step-up power supply circuit 3 is constituted by a series circuit of resistors $R_1$ and $R_2$, transistors $Q_1$ and $Q_2$, a resistor $R_4$, a diode $D_2$, a capacitor $C_2$, a transformer $T_1$, a transistor $Q_3$, a resistor $R_3$, a resistor $R_5$, and a diode $D_3$, as shown in FIG. 1. The transistors $Q_1$ and $Q_2$ and the resistor $R_4$ are connected parallel to the power supply battery $E_1$, and the diode $D_2$, the capacitor $C_2$, and the transformer $T_1$ are connected parallel to each other. The transistor $Q_3$ is connected to the primary side of the transformer $T_1$, and the resistor $R_3$ is connected between the transistor $Q_3$ and the resistor $R_4$. The resistor $R_5$ and the diode $D_3$ are connected to the secondary side of the transformer $T_1$.

The voltage detecting circuit 4 is constituted by a series circuit of resistors $R_6$ and $R_7$, a capacitor $C_4$ connected parallel to this series circuit, and a diode $D_4$ connected between the capacitor $C_4$ and the main capacitor $C_5$.

In addition, in the trigger circuit 5, resistors $R_8$, $R_9$, and R10, a thyristor $SCR_1$, capacitors $C_6$ and $C_7$, a resistor $R_{11}$, and a trigger transformer $T_2$ are connected to each other, as shown in FIG. 1. The trigger transformer $T_2$ is used to supply a trigger signal to the flash light discharge tube 6.

The IGBT 7 is connected in series with the flash light discharge tube 6 and the diode $D_5$. The IGBT 7 switches the light emission current of the flash light discharge tube 6 to control an emission amount, and the IGBT 7 operates in accordance with the state of a SCONT signal from the CPU 1.

A power switch SW1 and a release switch SW2 are connected to the CPU 1. In addition to the SCONT signal supplied to the IGBT 7, a CHG signal and an STRG signal are supplied from the CPU 1 to the step-up power supply circuit 3 and the trigger circuit 5, respectively. A VST signal is supplied from the voltage detecting circuit 4 to the CPU 1.

In addition, the CPU 1 performs camera sequence control and controls an electronic flash circuit. A power supply voltage $V_{DD}$ for the CPU 1 is supplied from the power supply battery $E_1$ through the power supply filter circuit 2.

In this case, prior to a description of the operation of the circuit, an IGBT will be described below.

FIG. 2 is a sectional view showing the structure of a general IGBT. As shown in FIG. 2, a $P^+$-type semiconductor layer 12 and an N-type semiconductor layer 13 are sequentially formed on the upper side of a collector electrode 11. A P layer 14, having an impurity concentration lower than that of the $P^+$ layer 12 and an $N^+$ layer 15 having an impurity concentration higher than that of the N layer 13 are formed on the surface of the N layer 13. The surface of the P layer 14 interposed between the N layer 13 and the $N^+$ layer 15 serves as a channel region.

A gate electrode 17 is formed on this channel region through a gate oxide film 16. An emitter electrode 19 is formed on the gate electrode 17 through an insulating film 18.

In the IGBT arranged as described above, when a positive gate voltage is applied to the emitter electrode 19, the above channel is formed in the gate electrode 17, and a current flows between a collector electrode and the emitter electrode. This gate voltage must be generally set to be about 10 V to 40 V. However, when a thinning process for the gate oxide film 16 or a micropatterning design rule are employed, a low-voltage gate driven IGBT capable of causing a satisfactory current to flow between a collector electrode and an emitter electrode even at a gate voltage of 4 V can be manufactured.

This embodiment describes an electronic flash light emission control circuit using the low-voltage gate driven IGBT.

The operation of the electronic flash apparatus will be described below with reference to timing charts shown in FIGS. 3A to 3F.

When the CHG signal from the CPU 1 is set at low level (FIG. 3A), the step-up power supply circuit 3 operates to charge the main capacitor $C_5$ with a boosted voltage VMC (FIG. 3B). This charge voltage VMC is monitored by the voltage detecting circuit 4. When the charge voltage VMC reaches a predetermined charge voltage, the VST signal is supplied to the CPU 1 (FIG. 3C). When the CHG signal is set at high level, the boosting operation is stopped.

Light emission is to be described next. In order to turn on the IGBT 7 prior to generation of a light emission start signal, the SCONT signal from the CPU 1 is set at high level (FIG. 3D). Thereafter, the STRG signal from the CPU 1 goes to high level in response to the light emission start signal (FIG. 3E), the thyristor $SCR_1$ is turned on, and the flash light discharge tube 6 is excited by the trigger circuit 5, thereby starting light emission (FIG. 3F). Thereafter, when the SCONT signal from the CPU 1 is set at low level while the flash light discharge tube 6 emits light, the IGBT 7 is turned off, and the light emission is stopped.

FIG. 4 is a circuit diagram of an output unit for a CONT terminal in the CPU 1. This output unit is constituted by a NAND circuit 20, a NOR circuit 21, an inverter 22, a p-channel (P-ch) transistor 23, and an n-channel (N-ch) transistor 24, as shown in FIG. 4. When the transistor 23 is turned on, and the transistor 24 is turned off, the voltage $V_{DD}$ is output from the CONT terminal. When the transistor 23 is turned off, and the transistor 24 is turned on, a voltage having a ground level is output.

In this case, when a 6-V battery is used as the power supply battery $E_1$, the voltage $V_{DD}$ is about 5.5 V which is lower than the voltage of the 6-V battery by a forward drop voltage $V_F$ of the diode $D_1$. At this time, a high-level voltage output from the CONT terminal is about 5.3 V because voltage drop occurs in the transistor 23. Since the above low-voltage drive IGBT is used as an IGBT, the IGBT can be turned on even at a voltage of 5.3 V (actually, about 4 V).

The IGBT may be turned on before the light emission start signal is generated, i.e., the SCONT signal from the CPU 1 may be set at high level, at any timing before the STRG signal from the CPU 1 is input to the IGBT. This timing may be a timing at which a camera is powered on or a timing at which emission of an electronic flash apparatus is required in a low-luminance state or the like. In addition, in an SLR (single-lens reflex camera), the timing may be a timing at which a release switch is depressed, a timing at which a mirror-up state is set, or the like.

Figure 5:
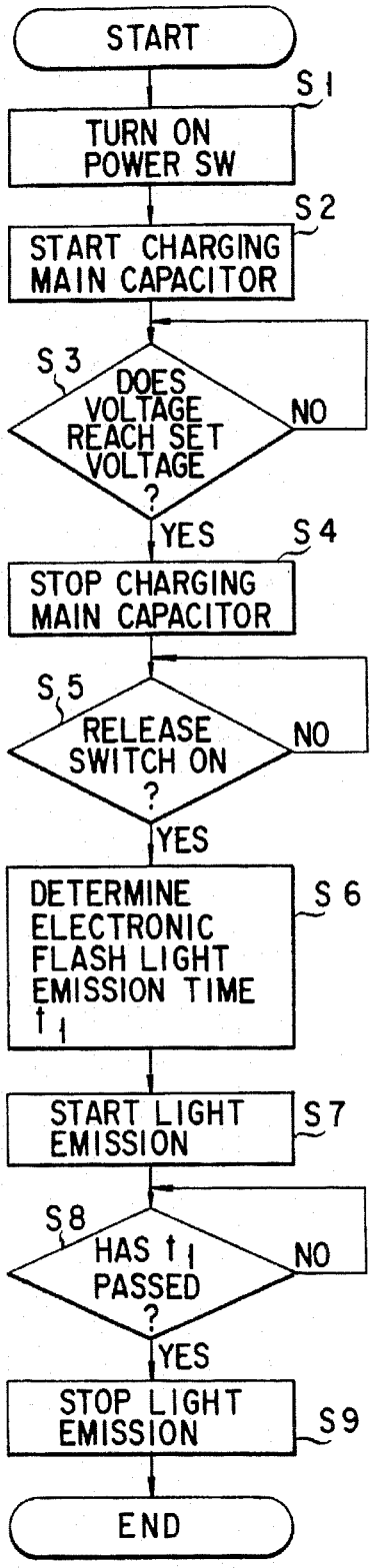
FIG. 5 is a flow chart for explaining an electronic flash control operation performed by the CPU 1 in the first embodiment.

An electronic flash control operation performed by the CPU 1 will be described below with reference to a flow chart in FIG. 5.

First, when the power switch SW1 is turned on (step S1), charging of the main capacitor $C_5$ is started by the step-up power supply circuit 3 (step S2). When the voltage of the main capacitor $C_5$ reaches a set charge voltage (step S3), charging of the main capacitor $C_5$ is stopped (step S4).

Thereafter, when the release switch is turned on (step S5), a light emission time $t_1$ for determining the light amount of the electronic flash is determined (step S6). Light emission is started (step S7). When the time $t_1$ has passed (step S8), the light emission is stopped (step S9).

The second embodiment of the present invention will be described below.

Figure 6:
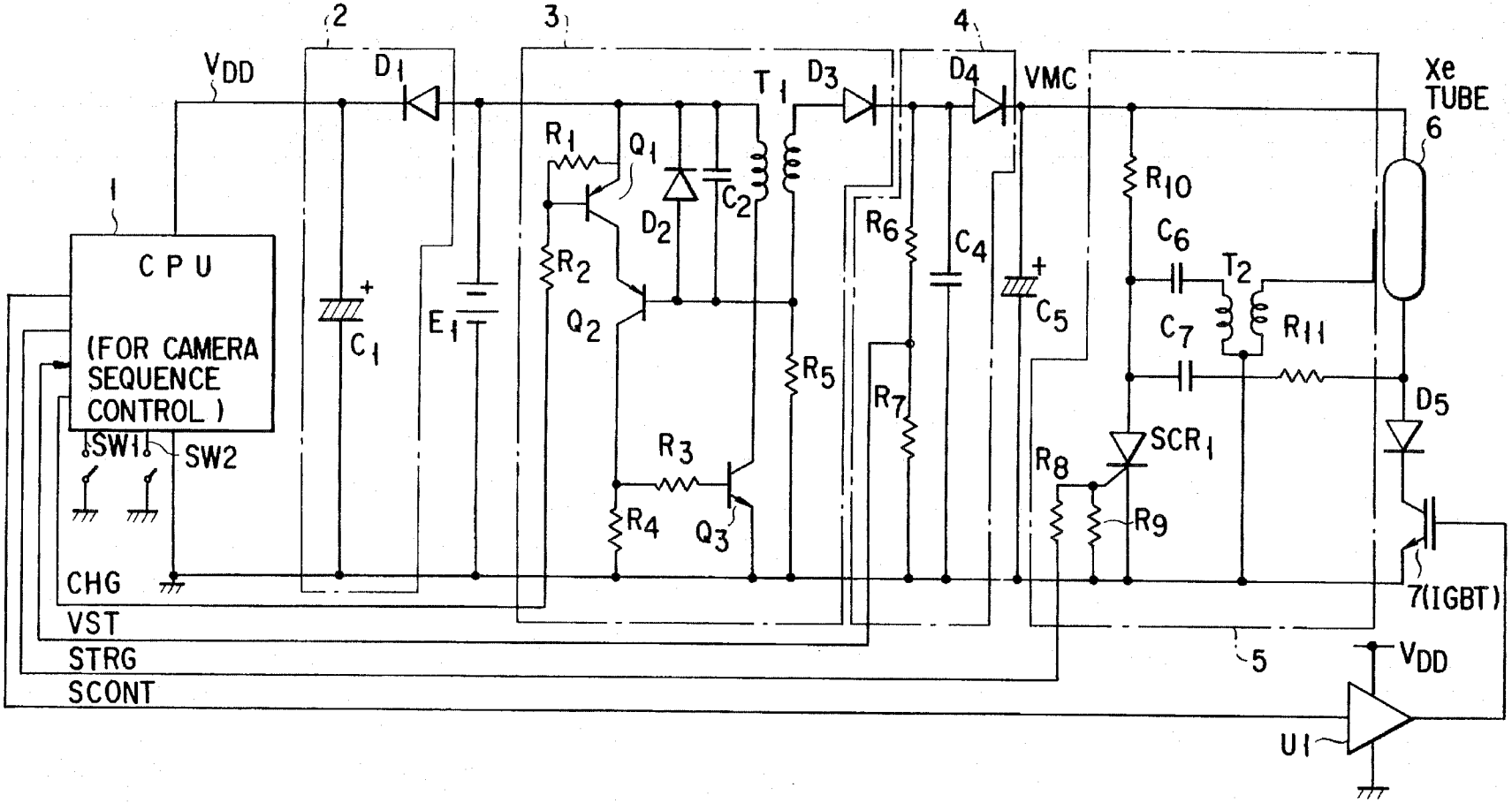
FIG. 6 is an electrical circuit diagram of an electronic flash apparatus according to the second embodiment of the present invention.

FIG. 6 is an electrical circuit diagram of an electronic flash apparatus according to the second embodiment of the present invention. The circuit arrangement of this electronic flash apparatus is almost the same as that of the circuit of the first embodiment in FIG. 1. In the circuit in FIG. 6, unlike in the circuit in FIG. 1, a voltage is applied to the gate of an IGBT 7 through a buffer U1. Therefore, since the voltage is applied through the buffer U1, a gate driven current to the IGBT 7 increases, and the IGBT 7 can be ON/OFF-controlled at a high speed.

The operation of the second embodiment will be described below with reference to timing charts in FIGS. 7A to 7G. Note that FIG. 7G is an enlarged view showing a portion represented by a time $t_2$ of an SCONT signal in FIG. 7D.

When a CHG signal from a CPU 1 is set at low level, a step-up power supply circuit 3 operates to charge a main capacitor $C_5$ with a boosted voltage (FIG. 7B). A charge voltage VMC is monitored by a voltage detecting circuit 4. When the charge voltage VMC reaches a predetermined charge voltage, a VST signal is supplied to the CPU 1 (FIG. 7C) to set the CHG signal at high, and the boosting operation is stopped.

Light emission is to be described next. When an STRG signal and an SCONT signal from the CPU 1 are set at high level in response to a light emission start signal (FIGS. 7D and 7E), the IGBT 7 is turned on, and, at the same time, a flash light discharge tube 6 is excited by a trigger circuit 5 to start light emission (FIG. 7F). At this time, the SCONT signal from the CPU 1 outputs a high/low-level pulse train at a very short cycle (FIGS. 7D and 7G). At this time, the IGBT 7 is repetitively turned on/off in the same cycle as that of the pulse train. Once the flash light discharge tube 6 is set in an excited state, the flash light discharge tube 6 can repeat slight light emission by turning on/off the IGBT 7 although the trigger circuit 5 does not trigger the flash light discharge tube 6 again. Almost flat light emission can be realized.

In a camera using a focal-plane shutter, by using the flat light emission, an electronic flash apparatus can also be used during slit exposure, and high-speed electronic flash tuning can be realized.

Figure 8:
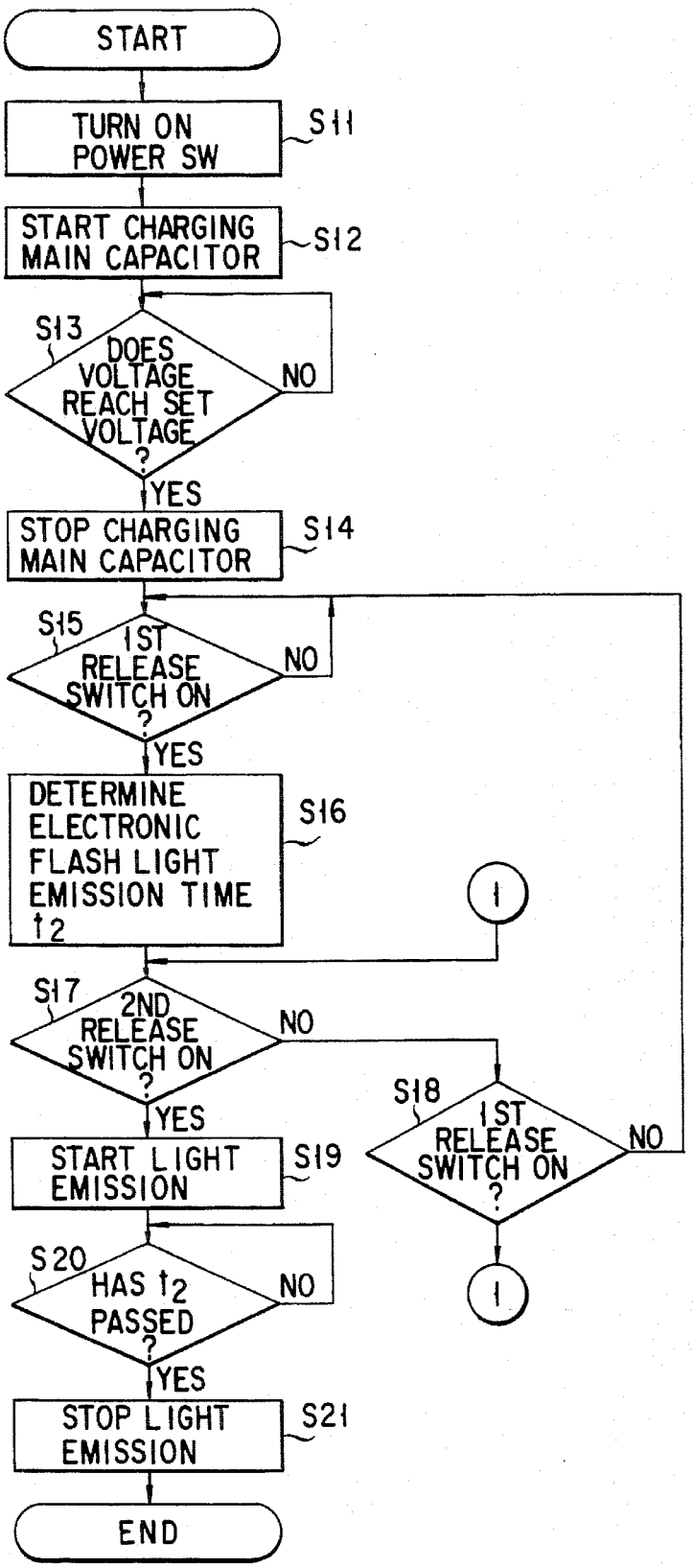
FIG. 8 is a flow chart for explaining an electronic flash control operation performed by a CPU 1 in the second embodiment.

An electronic flash control operation performed by the CPU 1 of the second embodiment will be described below with reference to a flow chart in FIG. 8.

When a power switch SW1 is turned on (step 11), charging of the main capacitor $C_5$ is started by the step-up power supply circuit 3 (step S12). Thereafter, when the voltage of the main capacitor $C_5$ reaches a set charge voltage (step S13), charging of the main capacitor $C_5$ is stopped (step S14). When a first release switch is turned on (step S15), a time $t_2$ for which the electronic flash apparatus continuously performs flat light emission is determined (step S16).

It is checked whether a second release switch is turned on (step S17). If NO in step S17, it is checked whether the first release switch is turned on (step S18). In this case, if YES in step S18, a waiting state for the second release switch is set. For this reason, the flow returns to step S17 to check whether the second release switch is turned on.

If NO in step S18, this state is a state wherein a photographic operation is temporarily stopped. In this case, since an object to be photographed may be replaced with another one, a light emission time must be determined again. Therefore, the flow returns to step S15 to check whether the first release switch is turned on. If YES in step S15, the light emission time is determined in step S16.

If YES in step S17, light emission is started (step S19). When the time $t_2$ has passed (step S20), the light emission is stopped (step S21).

In each of the above embodiments, an IGBT is used as a switching device for controlling light emission. However, the same circuit and operation as described above can be realized by another gate controlled device, e.g., a power MOSFET, an MCT (MOS Controlled Thyristor), or the like.

As has been described above, according to the first and second embodiments of the present invention, since the gate of an IGBT is directly driven by an IC such as a CPU or a logic IC, a drive circuit for driving the gate is not required. The space of an electronic flash apparatus can be decreased without making the circuit arrangement of the electronic flash apparatus as a whole complex, and the cost of the electronic flash apparatus can be reduced.

According to the first and second embodiments of the present invention, an electronic flash apparatus which does not require the gate control power supply circuit can be developed by causing the CPU to directly control the gate of the gate controlled switching device.

However, in order to practically use an electronic flash apparatus according to each of the first and second embodiment, the following item must be improved. More specifically, assume that the gate potential of the IGBT varies due to trigger noise generated by the trigger circuit at the start of light emission. In this case, the following problem is posed due to use of the low-voltage drive IGBT having a gate control voltage of about 4 V. Even when a variation in gate potential smaller than that of an intermediate-voltage drive IGBT having a gate control voltage of about 12 V to 13 V occurs, the gate potential of the low-voltage drive IGBT becomes lower than an on-thresh-gate voltage, and the start of light emission may be delayed, or a light emission current of a flash light emitting tube may flow at an insufficient gate voltage (low gate voltage). As a result, in the worst case, the IGBT may be broken down.

In order to solve this problem, for example, the gate line of the IGBT may be arranged greatly apart from the trigger circuit, or a shield may be arranged between the trigger circuit and the gate line to make it difficult the gate line to receive trigger noise. In addition, a new gate control circuit may be arranged to decrease the impedance of the gate line, thereby decreasing the influence of trigger noise. However, either case results in an increase in manufacturing cost or is subjected to limitations on an arrangement space.

The third embodiment of the present invention obtained by progressing the first and second embodiments with respect to the above points will be described below.

The arrangement of the third embodiment is the same as that of the first embodiment shown in FIG. 1 except for a manner of control performed by a CPU 1.

The operation of an electronic flash apparatus according to the third embodiment will be described with reference to timing charts shown in FIGS. 9A to 9F.

As shown in FIG. 9A, a CHG signal from a CPU 1 is set at low (Low) level (to be referred to as L level hereinafter), a step-up power supply circuit 3 operates to charge a main capacitor $C_5$ with a boosted voltage VMC as shown FIG. 9B. This charge voltage, as shown in FIG. 9C, is monitored by a voltage detecting circuit 4. When the charge voltage reaches a predetermined charge voltage, a VST signal is supplied to the CPU 1 to set the CHG signal at high (Hi) level (to be referred to as H level hereinafter), thereby stopping the boosting operation.

When light emission is to be performed, in response to a light emission start signal, as shown in FIG. 9E, an STRG signal from the CPU 1 goes to H level, and a thyristor $SCR_1$ is turned on. At this time, as shown in FIG. 9D, an SCONT signal from the CPU 1 is still at L level, and an IGBT 7 is in an OFF state.

When the thyristor $SCR_1$ is turned on, a flash light discharge tube 6 is excited by a trigger circuit 5, ionization occurs in the tube. At this time, light emission does not occur because the IGBT is in an OFF state. Even if light emission occurs, the light emission is weak only to charge the capacitors C7, as indicated by an arrow A in FIG. 9F.

As shown in FIG. 9D, the SCONT signal is set at H level a predetermined time $t_1$ after the STRG signal from the CPU 1 goes to H level (FIG. 9E), and the IGBT 7 is turned on. At this time, the interior of the flash light discharge tube 6 is still in an ionized state. For this reason, when the IGBT 7 is turned on, and a voltage is applied across the flash light discharge tube 6, the flash light discharge tube 6 starts light emission without triggering the flash light discharge tube 6 again (FIG. 9F).

For example, when a xenon tube in which a xenon gas is sealed is used, the ionization time described above is several μ s to several hundred μ s. That is, during the time $t_1$, the discharge tube can start light emission without supplying a trigger signal to the discharge tube again.

Thereafter, when the SCONT signal from the CPU 1 is set at L level, the IGBT 7 is turned off, and the light emission is stopped.

The reason why the SCONT signal is set at H level after the STRG signal from the CPU 1 is enabled in the embodiment described above will be described below with reference to FIGS. 10A to 10C and 11A to 11C.

FIGS. 10A to 10C show an example wherein the SCONT signal from the CPU 1 is set at H level before the STRG signal from the CPU 1 is set at H level as in the first embodiment. When the STRG signal from the CPU 1 goes to H level (FIG. 10A), a trigger voltage is generated by the trigger circuit 5 (FIG. 10B). The trigger voltage has a very high voltage value of several kV. When this noise is added to the SCONT signal from the CPU 1, the waveform of the SCONT signal from the CPU 1 fluctuates as shown in FIG. 10C, and the potential of the SCONT signal may be lower than the on-thresh-gate voltage of the IGBT 7. For this reason, the start of light emission by the flash light discharge tube 6 is delayed, or the light emission current of the flash light discharge tube 6 is caused to flow at an insufficient gate voltage (low gate voltage). In the worst case, the IGBT 7 may be broken down.

FIGS. 11A to 11C show an example wherein the SCONT signal from the CPU 1 is set at H level a predetermined time after the STRG signal from the CPU 1 rises. In this case, the SCONT signal from the CPU 1 is set at H level after the trigger waveform becomes flat, and no trigger noise is added to the H-level component of the SCONT signal. Therefore, the start of light emission is not delayed, and the IGBT is not broken down.

A variation in voltage caused by trigger noise when the SCONT signal from the CPU 1 is at L level is considerably smaller than that when the SCONT signal is at H level. This noise does not turn on the IGBT 7.

The reason of causing this phenomenon will be described below. An output port as of a CPU has the arrangement shown in FIG. 4 or an arrangement shown in FIG. 12.

The output port shown in FIG. 12 is constituted by a NAND circuit 31, an n-channel (N-ch) transistor 32, and a pull-up resistor 33 having a resistance of several hundred kΩ. The output port is a pull-up open-drain port. When the N-ch transistor is in an ON state, the open-drain port outputs a ground-level voltage from an SCONT terminal. When the N-ch transistor is in an OFF state, the open-drain port outputs a voltage $V_{DD}$.

Similarly, as described above, the output port shown in FIG. 4 is constituted by the NAND circuit 20, the NOR circuit 21, the inverter 22, the p-channel (P-ch) transistor 23, and an n-channel (N-ch) transistor 24 in an arrangement as shown in FIG. 4.

This output port is a complementary port. When the transistor 23 is in an ON state, and the transistor 24 is in an OFF state, the complementary port outputs a voltage $V_{DD}$ from the CONT terminal. In contrast to this, when the transistor 23 is in an OFF state, and the transistor 24 is in an ON state, the complementary port outputs a ground-level voltage.

When the open-drain port shown in FIG. 12 is used, an output impedance at H level is relatively high, and the open-drain port is easily influenced by the trigger noise described above. In the open-drain port, an output impedance at L level is low because the N-ch transistor is in an ON state. For this reason, the open-drain port is not easily influenced by the trigger noise.

In the complementary port shown in FIG. 4, although an output impedance at H level is not higher than that of the open-drain port, a current sink capability at L level is higher than a current source capability at H level. For this reason, the complementary port at H level is influenced by the trigger noise easier than the complementary port at L level.

Figure 13:
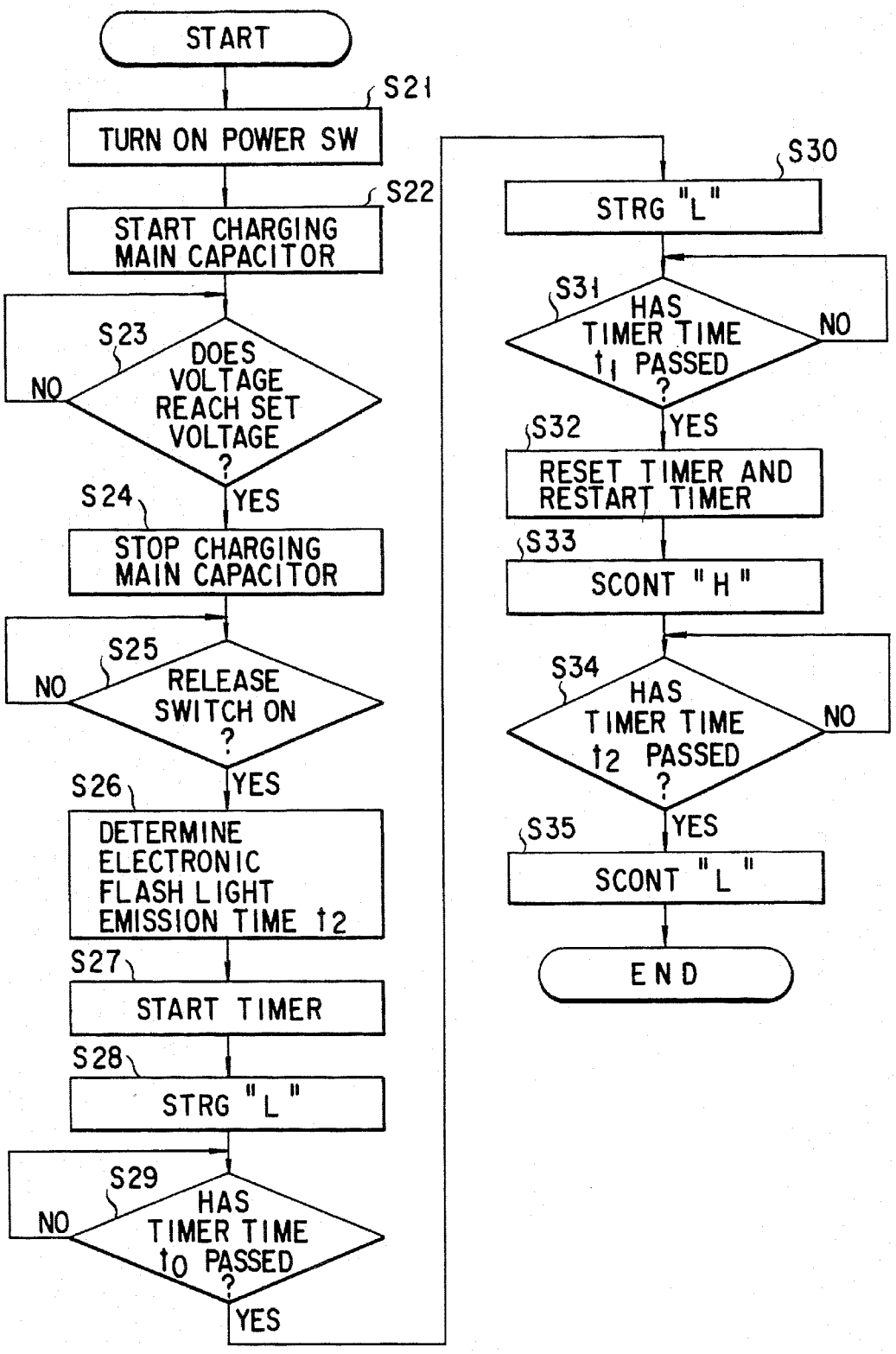
FIG. 13 is a flow chart for explaining an electronic flash apparatus control operation performed by a CPU in the electronic flash apparatus according to the third embodiment.

An electronic flash control operation performed by the CPU 1 of this embodiment will be described below with reference to a flow chart in FIG. 13.

When a power switch SW1 is turned on (step S21), the CPU 1 sets the CHG signal at L level and causes a step-up power supply circuit 3 to charge the main capacitor $C_5$ (step S22). The CPU 1 detects a charge voltage in accordance with a VST signal. When the charge voltage reaches a set charge voltage (step S23), the CPU 1 sets the CHG signal at H level and stops charging the main capacitor $C_5$ (step S24). Thereafter, when a release switch SW2 is turned on (step S25), the CPU 1 determines a light emission time $t_2$ for determining the light amount of the electronic flash on the basis of object distance information or photometric information (step S26).

The CPU 1 starts a timer (step S27), the STRG signal at L level is set at H level, and the thyristor $SCR_1$ is turned on, thereby triggering the Xe tube 6 (step S28). When a time $t_0$ set by the timer has passed (step S29), the CPU 1 sets the STRG signal at L level (step S30).

When a time $t_1$ set by the timer has passed (step S31), the CPU 1 resets the timer and restarts it (step S32). At the same timer, the CPU 1 sets the SCONT signal at H level, turns on the IGBT 7, and starts light emission of the discharge tube 6 (step S33). After the light emission, a time $t_2$ set by the timer has passed (step S34), the CPU 1 sets the SCONT signal at L level, turns off the IGBT 7, and stops the light emission (step S35).

Note that, although an IGBT is used as a switching device for controlling light emission in the third embodiment described above, the same circuit and operation as described above can be realized by another gate controlled device, for example, a power MOSFET, an MCT (MOS Controlled Thyristor), or the like.

Note that, according to the third embodiment, the following arrangements can be obtained.

(1) There is provided an electronic flash apparatus comprising a main capacitor for holding charges for causing a flash light emitting tube of the electronic flash apparatus to emit light, a gate controlled switching device connected in series with the flash light emitting tube in a discharge loop of the main capacitor, a trigger circuit for exciting the flash light emitting tube to start light emission, and a gate control circuit for ON/OFF-controlling the gate controlled switching device, characterized in that an ON signal for turning on the gate controlled switching device is input to the gate control circuit after a light emission start signal is input to the trigger circuit in response to a light emission start instruction.

(2) There is provided an electronic flash apparatus characterized by comprising a flash light emitting tube, a gate controlled switching device connected in series with the flash light emitting tube, and a light emission control means for outputting an ON signal for turning on the gate controlled switching device after a trigger signal for exciting the flash light emitting tube is output.

(3) There is provided an electronic flash apparatus according to the arrangement (1) or (2), characterized in that the gate controlled switching device is an IGBT.

(4) There is provided an electronic flash apparatus according to the arrangement (1) or (2), characterized in that the gate controlled switching device is an MCT (MOS Controlled Thyristor).

(5) There is provided an electronic flash apparatus according to the arrangement (1) or (2), characterized in that the gate controlled switching device is a power MOSFET.

(6) There is provided an electronic flash apparatus characterized by comprising a series circuit including a flash light discharge tube and a switching device which are inserted in a discharge loop of a main capacitor, a trigger means for receiving a trigger signal to excite the flash light discharge tube, and a light emission control means for outputting an energization control signal for energizing the switching device after the trigger signal is output.

(7) There is provided an electronic flash apparatus according to the arrangement (6) characterized in that the light emission control means is a microcomputer (CPU).

(8) There is provided an electronic flash apparatus according to the arrangement (7), characterized in that an output terminal of the microcomputer (CPU) is an open-drain terminal or a complementary port.

(9) There is provided an electronic flash apparatus according to the arrangement (7), characterized in that an output terminal of the microcomputer is connected to a gate terminal of the switching device.

(10) There is provided an electronic flash apparatus according to the arrangements (6) to (9), characterized in that the light emission control means outputs the energization control signal within a deionization time of the flash light discharge tube.

(11) There is provided an electronic flash apparatus according to the arrangements (6) to (10), characterized in that the switching device is a gate controlled switching device capable of controlling and driving a gate at a low voltage.

According to the aspects described in the arrangements (1) to (11), when a control signal for turning on the switching device is to be transmitted, the control signal is not influenced by noise, and the switching device is not broken down. According to the aspects described in the arrangements (7) to (9), the switching device can be directly controlled by the microcomputer, and a simple arrangement can be obtained. According to the aspect described in the arrangement (8), the arrangement which is higher resistant to noise can be obtained because of a low impedance or the like. According to the aspect described in the arrangement (10), since the energization control signal is transmitted to turn on the switching device within a deionization time, the switching device can be reliably rendered conductive.

As has been described above, according to the third embodiment of the present invention, there is provided an electronic flash apparatus, having a simple circuit arrangement in which the gate controlled switching device is turned on after a trigger signal is output to prevent trigger noise from delaying the start of light emission and prevent the gate controlled switching device from breakdown and which is free from limitations on an arrangement space for storing a circuit, for controlling a gate controlled switching device to control light emission.

Additional embodiments of the present invention will be apparent to those skilled in the art from consideration of the specification and practice of the present invention disclosed herein. It is intended that the specification and examples be considered as exemplary only, with the tube scope of the present invention being indicated by the following claims.

What is claimed is:

1. An electronic flash apparatus comprising:

a main capacitor for storing charges;

a discharge light emitting tube for emitting light in accordance with the charges stored in said main capacitor;

a CPU (Central Processing Unit) for performing camera sequence control, said CPU including a light emission control terminal for controlling a light emission timing of said discharge light emitting tube and said CPU being supplied with a CPU operation voltage; and an IGBT (Insulated Gate Bipolar Transistor) coupled to each of said discharge light emitting tube and said CPU, said IGBT having a gate terminal connected to said light emission control terminal of said CPU, a collector terminal, and an emitter terminal, wherein, responsive to said light emission control terminal inputting to said gate terminal a control voltage substantially equivalent in amplitude to said CPU operation voltage, a channel is formed between said collector terminal and said emitter terminal and the charges of said main capacitor are discharged through said discharge light emitting tube.

2. An apparatus according to claim 1, wherein said light emission control terminal of said CPU inputs a pulse train having a predetermined cycle to said gate terminal of said IGBT in response to a trigger signal output to said discharge light emitting tube such that a light emission luminance obtained when light emission occurs in said discharge light emitting tube is kept substantially constant while the pulse train is being input.

3. An apparatus according to claim 1, wherein said CPU inputs a light emission control signal to said gate terminal of said IGBT after a trigger signal is input to a trigger terminal of said discharge light emitting tube.

4. An electronic flash apparatus comprising:

a main capacitor for storing charges;

a discharge light emitting tube for emitting light in accordance with the charges stored in said main capacitor;

a CPU for performing camera sequence control, said CPU including a light emission control terminal for controlling a light emission timing of said discharge light emitting tube and said CPU being supplied with a CPU operation voltage; and a gate controlled switching device coupled to each of said discharge light emitting tube and said CPU, said gate controlled switching device having a gate terminal connected to said light emission control terminal of said CPU, a collector terminal, and an emitter terminal, wherein, responsive to said light emission control terminal inputting to said gate terminal a control voltage substantially equivalent in amplitude to said CPU operation voltage, a channel is formed between said collector terminal and said emitter terminal and the charges of said main capacitor are discharged through said discharge light emitting tube.

5. An apparatus according to claim 4, wherein said gate controlled switching device comprises an IGBT.

6. An electronic flash apparatus comprising:

a capacitor for storing charges;

a discharge light emitting tube arranged in a discharge loop of said capacitor;

an IGBT having a gate control electrode and collector and emitter electrodes, wherein said collector and emitter electrodes are connected in series with said discharge light emitting tube in the discharge loop of said capacitor; and a CPU having an output terminal directly connected to said gate control electrode of said IGBT for outputting to said IGBT a light emission control signal.

7. An electronic flash apparatus comprising:

a main capacitor for storing charges for causing a discharge light emitting tube to emit light;

charge control means for controlling a charge of said main capacitor;

a gate controlled switching device connected in series with said discharge light emitting tube in a discharge loop of said main capacitor;

gate control means for ON/OFF-controlling said gate controlled switching device to control discharging of said main capacitor in said discharge loop; and a common power supply for driving both of said charge control means and said gate control means.

8. An electronic flash apparatus comprising:

a main capacitor for storing charges for causing a discharge light emitting tube to emit light;

a gate controlled switching device having a gate control electrode and collector and emitter electrodes, wherein said collector and emitter electrodes are connected in series with said discharge light emitting device in a discharge loop of said main capacitor;

a control circuit having an output terminal directly connected to said gate control electrode of said gate controlled switching device for outputting to said gate control electrode a control signal for repetitively ON/OFF-controlling said gate controlled switching device in response to a pulse train so as to repetitively cause said discharge light emitting tube to emit light; and a common power supply for driving both of said gate controlled switching device and said control circuit.

9. An electronic flash apparatus comprising:

a main capacitor for storing charges;

a discharge light emitting tube for emitting light in accordance with the charges stored in said main capacitor;

a CPU for performing camera sequence control, said CPU including a light emission control terminal for controlling a light emission timing of said discharge light emitting tube and said CPU being supplied with a CPU operation voltage;

trigger means for receiving a trigger signal from said CPU to excite said discharge light emitting tube; and an IGBT having a gate terminal connected to said light emission control terminal of said CPU, a collector terminal, and an emitter terminal, wherein after said trigger means excites said discharge light emitting tube said light emission control terminal of said CPU inputs to said gate terminal a control voltage substantially equivalent in amplitude to said CPU operation voltage and wherein, responsive to said input of said control voltage to said gate terminal, a channel is formed between said collector terminal and said emitter terminal and said main capacitor is discharged through said discharge light emitting tube.

10. An apparatus according to claim 9, wherein said CPU outputs a control signal to said IGBT within a deionization time of said discharge light emitting tube.

11. An electronic flash apparatus comprising:

a main capacitor for storing charges;

a discharge light emitting tube for emitting light in accordance with the charges stored in said main capacitor;

a CPU (Central Processing Unit) for performing camera sequence control, said CPU including a light emission control terminal for controlling a light emission timing of said discharge light emitting tube and said CPU being supplied with a CPU operation voltage; and an IGBT having a gate terminal connected to said light emission control terminal of said CPU, a collector terminal, and an emitter terminal, wherein, responsive to said light emission control terminal inputting to said gate terminal a control voltage almost equal to said CPU operation voltage, a channel is formed between said collector terminal and said emitter terminal and the charges of said main capacitor are discharged through said discharge light emitting tube; and wherein said CPU inputs a light emission control signal to said gate terminal of said IGBT after a trigger signal is input to a trigger terminal of said discharge light emitting tube.

12. An electronic flash apparatus comprising:

a main capacitor for storing charges;

a discharge light emitting tube for emitting light in accordance with the charges stored in said main capacitor;

a CPU for performing camera sequence control, said CPU including a light emission control terminal for controlling a light emission timing of said discharge light emitting tube and said CPU being supplied with a CPU operation voltage; and a gate controlled switching device having a gate terminal connected to said light emission control terminal of said CPU, a collector terminal, and an emitter terminal, wherein, responsive to said light emission control terminal inputting to said gate terminal a control voltage almost equal to said CPU operation voltage, a channel is formed between said collector terminal and said emitter terminal and the charges of said main capacitor are discharged through said discharge light emitting tube; and wherein said CPU inputs a light emission control signal to said gate terminal of said gate controlled switching device after a trigger signal is input to a trigger terminal of said discharge light emitting tube.

13. An electronic flash apparatus comprising:

a main capacitor for storing charges for causing a discharge light emitting tube to emit light;

a gate controlled switching device having a gate control electrode and collector and emitter electrodes, wherein said collector and emitter electrodes are connected in series with said discharge light emitting device in a discharge loop of said main capacitor;

a control circuit having an output terminal directly connected to said gate control electrode of said gate controlled switching device for outputting to said gate control electrode a control signal for repetitively ON/OFF-controlling said gate controlled switching device in response to a pulse train so as to repetitively cause said discharge light emitting tube to emit light; and wherein said control circuit inputs a light emission control signal to said gate control electrode of said gate controlled switching device after a trigger signal is input to a trigger terminal of said discharge light emitting tube.

14. An electronic flash apparatus according to claim 13, wherein said light emission control signal is almost equal to an operation voltage of said control circuit.

15. An electronic flash apparatus according to claim 14, wherein said operation voltage is a power supply voltage applied to said control circuit.

* * * * *

UNITED STATES PATENT AND TRADEMARK OFFICE

CERTIFICATE OF CORRECTION

PATENT NO. : 5,532,555

DATED : July 2, 1996

INVENTOR(S) : YAMADA, Hiroshi

It is certified that error appears in the above-identified patent and that said Letters Patent is hereby corrected as shown below:

Title page, Item [56] References Cited,

Under "U.S. PATENT DOCUMENTS"

line 4, "Haguide" should be --Hagiuda--.

Under "FOREIGN PATENT DOCUMENTS", (Column 2)

line 1, "3-28031" should be -- 3-208031--
line 9, "4-13897" should be -- 4-138697--.

Signed and Sealed this

Twenty-ninth Day of December, 1998

*Attest:*

Bruce Lehman

BRUCE LEHMAN

*Attesting Officer*

*Commissioner of Patents and Trademarks*